United States Patent [19]

Helbling

[11] 3,948,233

[45] Apr. 6, 1976

[54] INTERNAL COMBUSTION ENGINE WITH POLLUTION CONTROL ARRANGEMENT

[76] Inventor: Edward Helbling, 726 E. 10th St., Brooklyn, N.Y. 11230

[22] Filed: Mar. 7, 1974

[21] Appl. No.: 448,930

[52] U.S. Cl. ..... 123/119 A; 123/134

[51] Int. Cl.[2] ..... F02M 25/06

[58] Field of Search ..... 123/134, 119 A

[56] References Cited

UNITED STATES PATENTS

| | | | |
|---|---|---|---|
| 474,838 | 5/1892 | Lambert | 123/134 |
| 1,456,025 | 5/1923 | Lee | 123/134 |
| 2,071,116 | 2/1937 | French | 123/134 X |
| 2,312,151 | 2/1943 | Crabtree et al. | 123/134 |
| 2,430,852 | 11/1947 | Allen | 123/134 |
| 2,956,559 | 10/1960 | Johnson | 123/119 A |
| 3,702,110 | 11/1972 | Hoffman et al. | 123/119 A |
| 3,713,429 | 1/1973 | Dwyre | 123/134 |
| 3,786,635 | 1/1974 | Kates | 123/119 A |
| 3,800,533 | 4/1974 | Zamkowski | 123/134 X |

*Primary Examiner*—Wendell E. Burns
*Attorney, Agent, or Firm*—Michael J. Striker

[57] ABSTRACT

An internal combustion engine has an intake for air and for liquid fuel to be combusted, and an exhaust manifold for combustion gases. A closed casing is adapted to contain a quantity of the liquid fuel and a first conduit connects the interior of this casing with the exhaust manifold so that combustion gases from the latter are admitted into the closed casing. Baffles in the casing force the combustion gases to travel through the liquid fuel therein, to become enriched with the fuel, whereupon the thus-enriched combustion gases are returned via a second conduit to the intake of the internal combustion engine to become mixed with the incoming air and liquid fuel and to undergo another combustion cycle in order to fully combust any residual uncombusted matter.

3 Claims, 5 Drawing Figures

INTERNAL COMBUSTION ENGINE WITH POLLUTION CONTROL ARRANGEMENT

BACKGROUND OF THE INVENTION

The present invention relates generally to internal combustion engines, and more particularly to internal combustion engines having a pollution control arrangement.

The pollution problems caused by operation of internal combustion engines, particularly those installed in automotive vehicles, are becoming of ever increasing concern. Many attempts have already been made to eliminate as many as possible of the pollutants from the exhaust gases of internal combustion engines. These pollutants include unburned hydrocarbons and the like which, in accordance with increasingly strict governmental standards, must be removed from the combustion gases before the same can be vented to the ambient atmosphere.

The prior-art proposals have various degrees of effectiveness, but as a general proposition they are not nearly as satisfactory—in terms of removal of pollutants as well as in terms of simplicity of construction and operation of the devices required—as is desirable.

SUMMARY OF THE INVENTION

Accordingly, it is an object of the present invention to overcome the disadvantages of the prior art.

More particularly, it is an object of the present invention to provide, in an internal combustion engine, a pollution control arrangement which avoids the aforementioned disadvantages.

An additional object of the invention is to provide such a pollution control arrangement which is highly effective in removing pollutants from the combustion gases.

Still a further object of the invention is to provide such a pollution control arrangement which is relatively simple in its construction and reliable in operation.

In keeping with these objects, and with others which will become apparent hereafter, one feature of the invention resides, in an internal combustion engine having an intake for air and liquid fuel to be combusted, and an exhaust manifold for combustion gases, in a combination which comprises a closed casing adapted to contain a quantity of the liquid fuel, and first conduit means which connects the interior of the closed casing with the exhaust manifold. Thus, combustion gases from the latter are admitted into the closed casing. Baffle means is provided in the casing for forcing the combustion gases to travel through the liquid fuel in the casing to thereby become enriched with the fuel, whereupon the thus-enriched combustion gases are returned via second conduit means to the intake for mixing with the incoming air and liquid fuel in preparation for undergoing a second combustion cycle.

Thus, unlike one prior-art proposal wherein the combustion gases are directly returned into the engine to undergo a second combustion cycle, the present invention proposes to enrich the combustion gases with the same type of fuel that is being combusted in the engine, to thereby provide for a more complete combustion of the residual combustible matter in the combustion gases.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
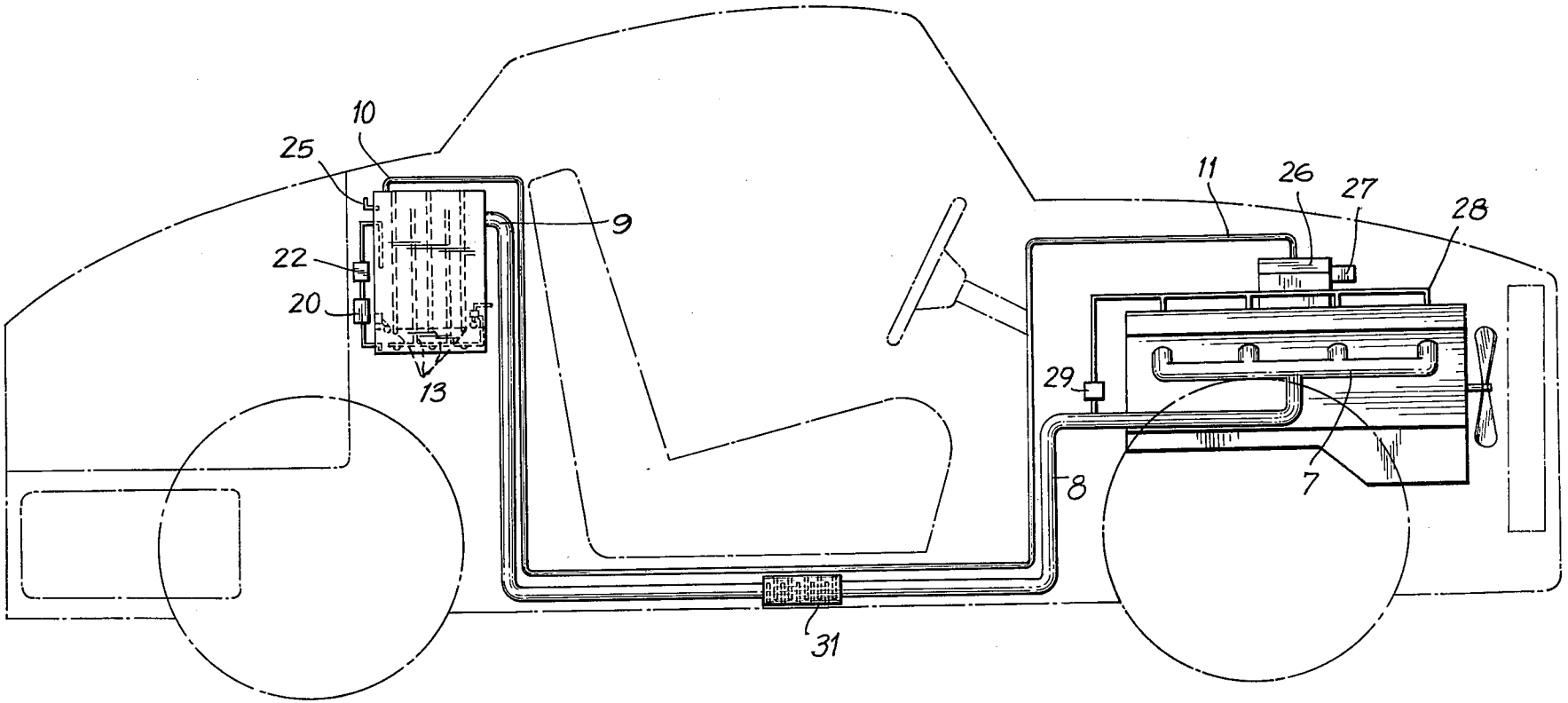
FIG. 1 is a diagrammatic side view showing an arrangement according to the present invention installed in a motor vehicle.
Figure 2:
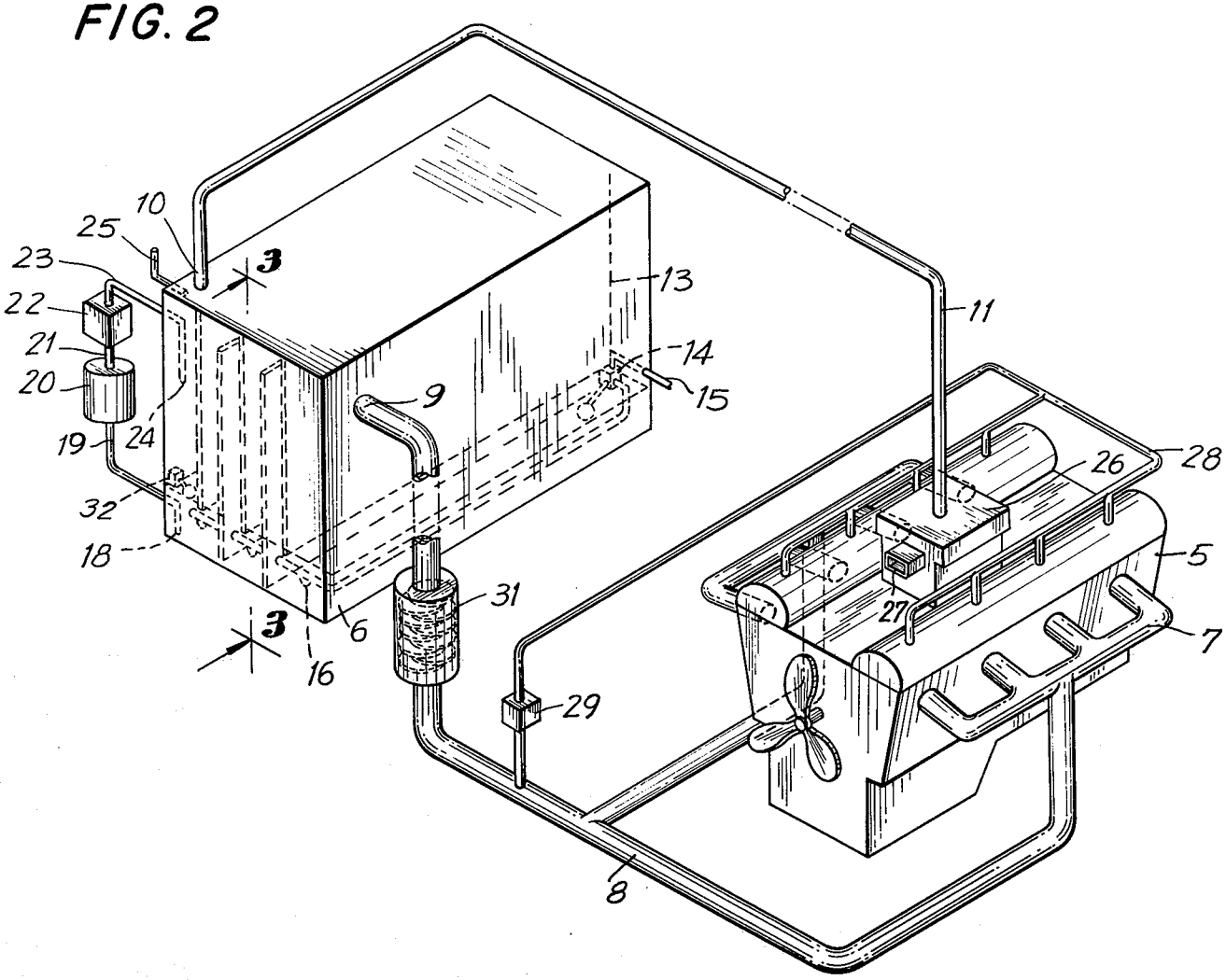
FIG. 2 is a perspective view, showing the arrangement of FIG. 1 in more detail.

Referring firstly to FIGS. 1–4 it will be seen in FIG. 1 I have illustrated in broken lines and only diagrammatically an automotive vehicle in which the arrangement according to the present invention is installed. The showing of the automotive vehicle is merely for purposes of orientation, to show where in the vehicle the arrangement can be located. However, location in different manner is also possible, just as it should be understood that the invention is applicable to internal combustion engines which are not installed in automotive vehicles.

With this in mind it will be seen that reference numeral 5 identifies a cylinder block of an internal combustion engine, for instance an Otto engine. No details of the construction and operation of this engine are necessary, because these are of course conventional. Reference numeral 6 identifies an exhaust manifold through which hot combustion gases issue from the engine after having been produced therein as a result of the combustion of a mixture of fuel and air. The fuel is admitted through the carburetor 26 and air is admitted via a fresh-air intake 27.

According to the invention there is provided a closed casing 6 which may but need not be located in the trunk compartment of the vehicle. The interior of the casing 6, which latter is closed with respect to the ambient atmosphere as will become clearer later, is connected with the manifold 7 via a conduit 8, 9 in which a flame and spark arrestor 31 is interposed. It should be understood that it is also possible to interpose in the conduit 8, 9, in addition to or in lieu of the device 31, a cooling arrangement, for instance an auxiliary radiator or the like, in order to cool the combustion gases to some extent.

The combustion gases are admitted into the casing 6 the interior of which is subdivided into a plurality of compartments **13*a* by baffles 13 which alternately extend from the bottom of the casing upward towards but short of the top, and from the top of the casing downward towards but short of the bottom. This forces the gases to travel from one compartment into another around the respective baffles, in the serpentine path which is shown by the arrows in FIG. 3**.

The casing 6 accommodates a quantity or body of the same liquid fuel that is being combusted in the combustion engine, for instance gasoline. The upper level of the body of gasoline is identified with reference numeral 30. Since, as will become apparent presently, the gases travelling through the compartments 13*a* become enriched with the gasoline so that the quantity of gasoline in the casing 6 diminishes, it is necessary to provide for replenishing by means of a conduit 15 which is connected with the non-illustrated fuel pump that supplies fuel to the combustion engine from the fuel tank. A float valve 14 of conventional construction is interposed in the conduit 15 within the casing 6 and, when it senses that the level 30 has dropped below a predetermined level, it will open the conduit 15 and permit inflow of additional gasoline from the pump until the rising level causes the float valve 14 to shut off again. Since the compartments 13*a* are separated from one another in the illustrated embodiment, a separate conduit 16 may extend from the float valve 14 through the baffles 13 which extend upwardly from the bottom wall, and may be provided with outlet nozzles 16*a*, to assure that the level of fuel in the several compartments 13*a* will always be uniform. Of course, it would be possible to eliminate the conduit 16 and nozzles 16*a* and simply to provide the upwardly extending baffles 13 with apertures adjacent the bottom wall of the casing 6 by means of which the compartments 13*a* can communicate.

Figure 3:
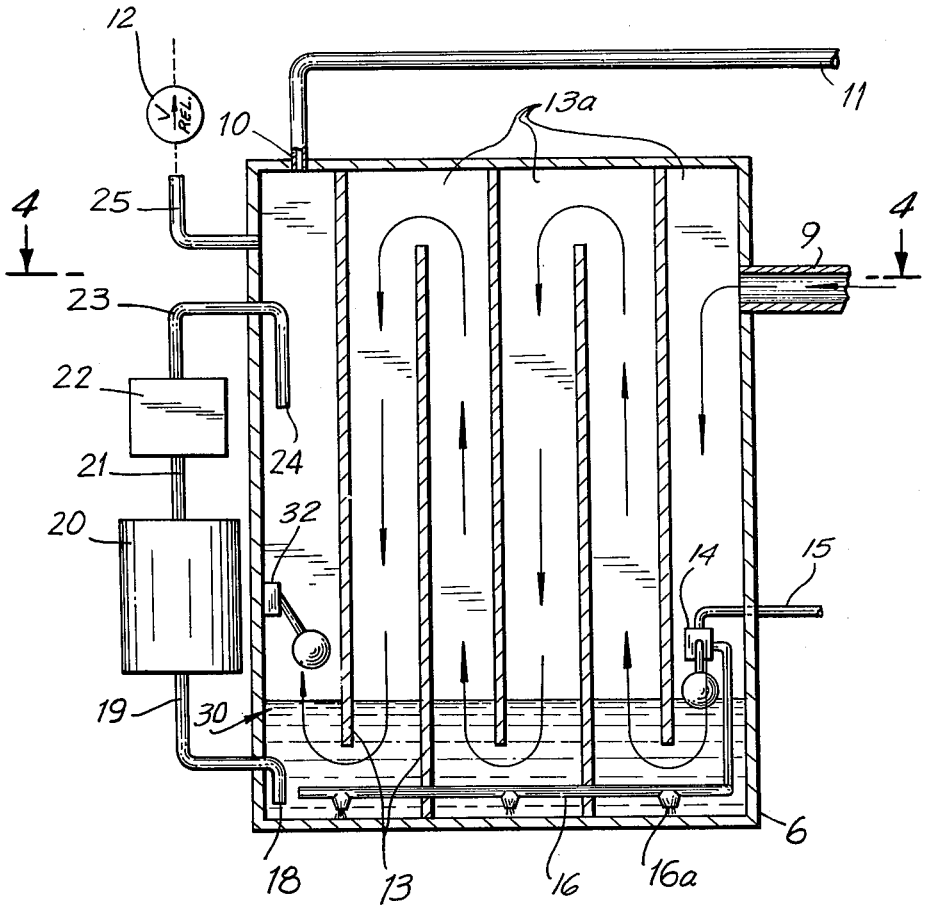
FIG. 3 is a vertical section taken on line 3—3 of FIG. 2.
Figure 4:
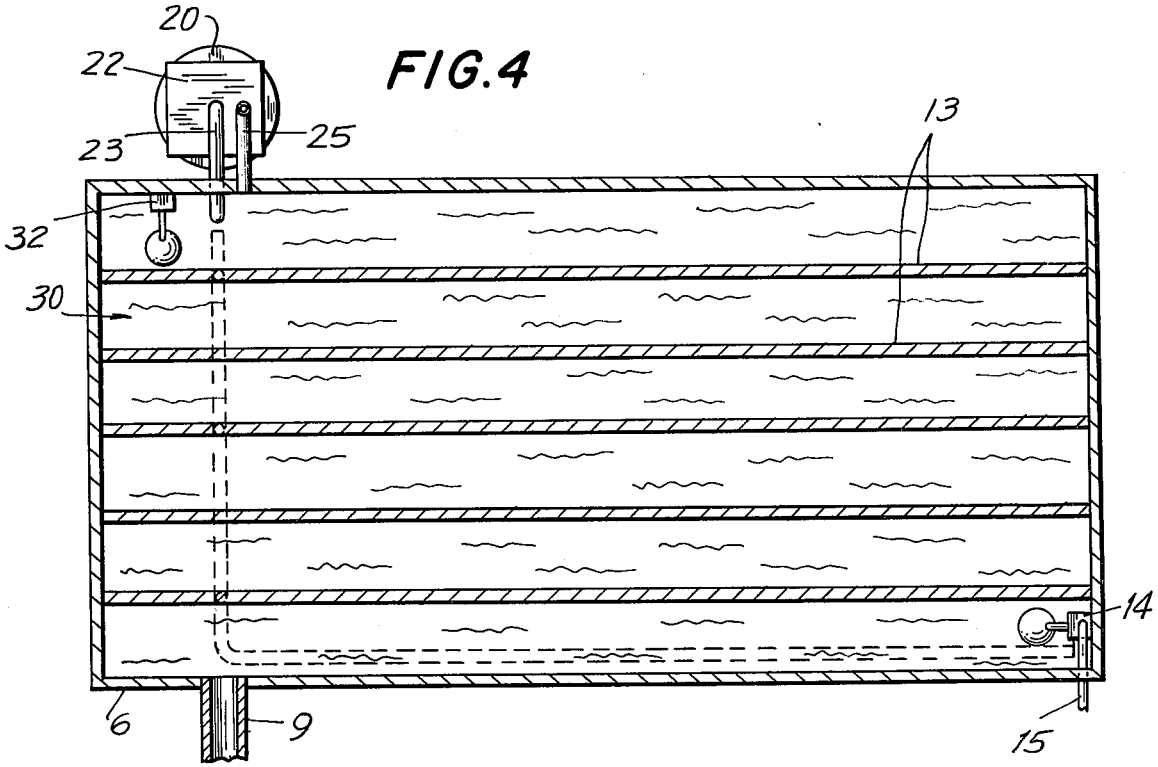
FIG. 4 is a section taken on line 4—4 of FIG. 3.

As the arrows in FIG. 3 show, the combustion gases from the conduit 8, 9 will travel sequentially through the compartments 13*a*, and during their transition from one compartment to the next-following one they must travel through the body of fuel, whereby they become enriched with the fuel. Finally, from the final compartment 13*a* the thus-enriched combustion gases are vented via the conduit 10, 11 back to the carburetor 26 of the combustion engine wherein they become admixed with the newly incoming fresh air and fuel to be combusted. Thus, they undergo another combustion cycle in the combustion engine and any residual combustible matter in these gases is reliably combusted, a process which is significantly improved by the fact that the gases have been enriched with the fuel during their passage through the casing 6.

Since the gases tend to carry with them particulate pollutants, such as carbon particles, that will be scrubbed out of them as they travel through the fuel in the casing 6, it is desirable that these pollutants be removed from the fuel. For this purpose, a conduit 19, 21, 23, is provided, having an inlet 18 through which fuel can be drawn from the casing 6 and an outlet 24 through which the fuel is returned into the casing. Interposed in this conduit are a filter 20 and a pump 22 of conventional construction, so that the fuel is filtered as it passes through the filter 20 before it is returned by the pump 22 into the interior of the casing 6. The filter 20 can be of the type that can be periodically cleaned, or else of the type which has a replaceable filter element so that a clogged element can be periodically replaced with a new one.

A vent 25 is provided in which a pressure relief valve 12 is interposed. This pressure relief valve, which again can be of conventional construction, is of the type which, when the pressure in the casing 6 exceeds a predetermined limit, will operate to vent the casing so as to relieve the pressure. This is of course necessary in order to prevent bursting of the casing 6 and interference with the proper operation of the combustion engine. The casing 6 is entirely closed with respect to the ambient atmosphere, in order to prevent the entrance of oxygen that could support the formation of an explosive mixture above the level of liquid fuel. For this reason the valve 12 must not allow the entry of air when it operates.

Reference numeral 29 identifies a solenoid switch in a conduit 28 which communicates with the several cylinders of the combustion engine and with the conduit 8, so that by opening of the solenoid switch 29 compression can be removed from the cylinders if required at engine-off position, to avoid dieseling.

Figure 5:
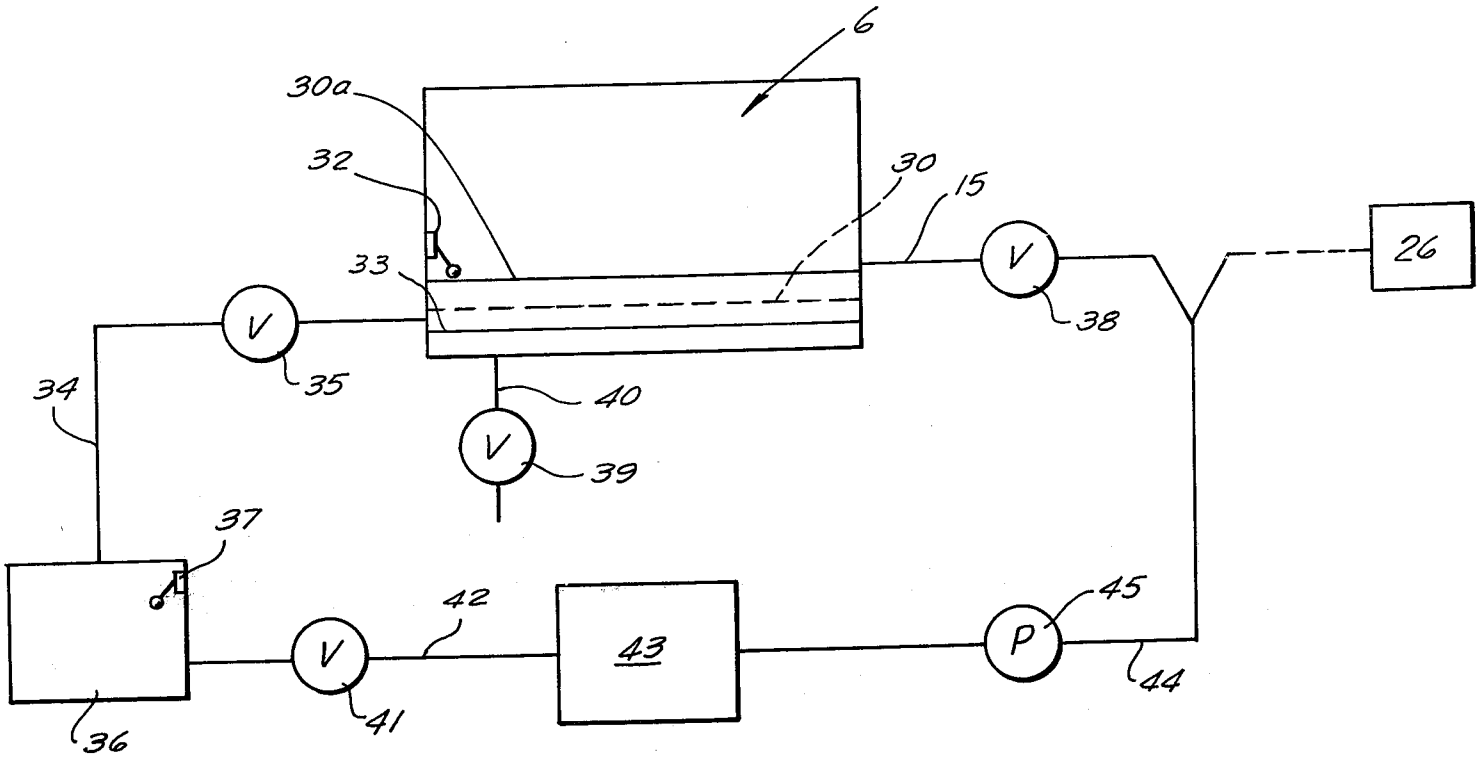
FIG. 5 is a schematic view, illustrating a further embodiment of the invention.

The embodiment in FIG. 5 has been shown only diagrammatically and should be understood to be essentially analogous to that of FIGS. 1–4. For purposes of better illustration, a device 32 has been shown in the embodiment of FIGS. 1–4 where, however, it will not ordinarily be required. Instead, the device 32 in these Figures should be read in conjunction with the embodiment of FIG. 5 in which it will be needed.

Like reference numerals in FIG. 5 identify like components as in the preceding embodiment.

Combustion gases originating in an internal combustion engine tend to carry with them a certain amount of moisture which will eventually collect in the casing 6. Since such fuel as gasoline floats on water, the moisture will settle to the bottom of the casing 6 and the fuel will float on top of it. It is necessary that the water be periodically vented from the casing 6.

The normal level 30 of the fuel in the casing 6 is shown in broken lines in FIG. 5. Reference numeral 33 identifies the level of water which is allowed to accumulate in the casing 6 and on top of which the fuel will then float. The float valve 14 of FIGS. 1–4 will open when the level 30 drops below the present limit, and will close again when it rises to the present limit. If, however, water accumulates in the casing 6, the fuel will float on top of the water and will eventually reach an upper level 30*a* as shown in FIG. 5. Since reaching of this level 30*a* will always be indicative of a certain amount of water at the bottom of the casing 6, the level 30*a* can be used to trigger the venting of the water from the casing. The device 32 is provided for this purpose, involving a switch which is controlled by a float that responds—when the level 30*a* is reached—by operating the switch. The switch in turn will open a valve 35 which is interposed in a conduit 34 having an inlet end which is so positioned that it communicates with the interior of the casing 6 at a level just above the level 33 which will have been reached at the time the fuel reaches the level 30*a*. Therefore, when the conduit 34 is opened by operation of the valve 35, the fuel can drain out of the casing 6 through the conduit 34, leaving behind only the water whose upper level is identified with reference numeral 30. The conduit 34 communicates with a receptacle 36 which is so dimensioned that when all or part of the fuel from the casing 6 has drained into it, the level of fuel in the receptacle 36 will be high enough to operate a float-controlled switch 37 similar to the switch 32. In known manner the switch 37 will be connected with the valve 35 which it will close when the switch 37 is operated by the rising level of fuel in the receptacle 36. In addition, the switch 37 will be connected with a valve 39 that is interposed in an outlet conduit 40, opening the valve 39 so that the water can drain out of the casing 6 and can be vented onto the road or into a collecting receptacle if desired. In the meantime, the switch 32 will have become inactivated again as its float drops. At the same time as the switch 37 opens the valve 39 it will close a valve 38 interposed in the conduit 15, to prevent the admission of additional fuel into the casing 6, which would otherwise be the case as the float valve 14 registers a drop in the liquid level below the present level at which it normally adds further fuel to the casing 6. Finally, the switch 37 will also have opened a valve 41 which is interposed in a conduit 42 connecting the receptacle 36 with the fuel tank 43 of the vehicle, so that the fuel in the receptacle 36 can now drain off into the fuel tank 43. When this has taken place, the switch 37 will return to its inoperative state, thereby closing the valves 39 and 41 and opening the valve 38 so that, in response to the operation of the float valve 14, fuel can now again be admitted into the casing 6 which is connected with the fuel tank 43 via the conduit 15, the valve 38, the conduit 44 and the interposed fuel pump 45. The admission of new fuel into the casing 6 will continue until the level 30 has been reached, at which time the valve 14 will automatically shut off the flow of further fuel into the casing 6.

It should be understood that various modifications of the illustrated and described embodiments can be made and are within the skill of the art, and that such modifications are intended to be encompassed within the scope of the invention and of the appended claims.

It will be understood that each of the elements described above, or two or more together, may also find a useful application in other types of constructions differing from the types described above.

While the invention has been illustrated and described as embodied in an internal combustion engine having a pollution control arrangement, it is not intended to be limited to the details shown, since various modifications and structural changes may be made without departing in any way from spirit of the present invention.

Without further analysis, the foregoing will so fully reveal the gist of the present invention that others can, by applying current knowledge, readily adapt it for various applications without omitting features which, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. In an internal combustion engine having an intake for air and liquid fuel to be combusted, and an exhaust manifold for combustion gases, a combination comprising a closed casing adapted to contain a quantity of said liquid fuel; first conduit means connecting the interior of said closed casing with said exhaust manifold, so that combustion gases from the latter are admitted into said closed casing; baffle means in said closed casing for forcing said combustion gases to travel through said liquid fuel to thereby become enriched with the same; second conduit means for returning the enriched combustion gases to said intake for mixing with the incoming air and liquid fuel; filter means; and circulating means for circulating the liquid fuel in said casing through said filter means so as to remove contaminants yielded up to said liquid fuel in said closed casing by said combustion gases.

2. In an internal combustion engine having an intake for air and liquid fuel to be combusted, and an exhaust manifold for combustion gases, a combination comprising a closed casing adapted to contain a quantity of said liquid fuel; first conduit means connecting the interior of said closed casing with said exhaust manifold, so that combustion gases from the latter are admitted into said closed casing; baffle means in said closed casing for forcing said combustion gases to travel through said liquid fuel to thereby become enriched with the same; second conduit means for returning the enriched combustion gases to said intake for mixing with the incoming air and liquid fuel; and means for automatically draining from the interior of said closed casing such quantities of water as periodically accumulate therein.

3. A drive, comprising an internal combustion engine having an intake for air and liquid fuel to be combusted, an exhaust manifold for combustion gases and a source of the liquid fuel; a closed casing adapted to contain a quantity of liquid; first conduit means connecting the interior of said closed casing with said exhaust manifold, so that combustion gases from the latter are admitted into said closed casing; depressurizing-baffle means in said closed casing for forcing said combustion gases to travel through said liquid; means for removing pollutants from said combustion gases; second conduit means connecting the interior of said closed casing with said intake for returning said combustion gases to said intake for mixing with the incoming air and liquid fuel; and means for automatically replenishing the liquid fuel in said closed casing so as to compensate for the loss of fuel from said quantity which results from enrichment of said combustion gases.

* * * * *